US006495026B1

(12) United States Patent
Herbert et al.

(10) Patent No.: US 6,495,026 B1
(45) Date of Patent: Dec. 17, 2002

(54) PROCESS TO SEVER METAL FIBERS USING GALVANIC CELL

(75) Inventors: William G. Herbert, Williamson, NY (US); Catherine N. Byers, Sterling, NY (US); Gary J. Maier, Webster, NY (US); Jennifer Hwang, Penfield, NY (US); Garry O. Glanzel, Wolcott, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/969,461

(22) Filed: Oct. 1, 2001

(51) Int. Cl.[7] ..... C25F 5/00

(52) U.S. Cl. ..... 205/706; 205/717; 205/657; 205/741

(58) Field of Search ..... 205/704, 706, 205/717, 657, 741

(56) References Cited

U.S. PATENT DOCUMENTS 4,161,434 A * 7/1979 Quinlan et al. ..... 205/717
5,997,722 A 12/1999 Vidal et al. ..... 205/711
6,048,657 A 4/2000 Herbert et al. ..... 430/127

OTHER PUBLICATIONS

William G. Herbert et al., "Electrochemical Process to Sever Metal Fibers", Ser. No. 09/918,782, Filed Jul. 31, 2001 (D/99681).

* cited by examiner

*Primary Examiner*—Arun S. Phasge
(74) *Attorney, Agent, or Firm*—Zosan S. Soong

(57) ABSTRACT

A process including: creating a galvanic cell composed of a substrate as an anode, a cathode, and an electrolytic solution, wherein the substrate includes a metal surface having a plurality of metal fibers connected to the metal surface, wherein the cathode is selected to be more noble than the metal surface resulting in the anode being the working electrode, wherein the galvanic cell spontaneously electrochemically treats the metal surface in the absence of power externally supplied to the galvanic cell; and allowing the spontaneous electrochemical treatment of the metal surface to continue for a time sufficient to sever a number of the metal fibers from the metal surface to result in severed metal fiber fragments unconnected with the metal surface.

12 Claims, No Drawings

PROCESS TO SEVER METAL FIBERS USING GALVANIC CELL

BACKGROUND OF THE INVENTION

Substrates for industrial applications frequently are required to have exacting dimensional tolerances, and in some situations also are required to have non-reflective surfaces. The exacting dimensional tolerances can be obtained via lathing or grinding. Of the two methods, grinding provides the more exacting dimensional tolerances. The lathed surface may be roughened via, for example, honing, when a non-reflective surface is required or, in some cases, rough lathed. Lathing and grinding, however, may produce metal fibers connected to the surface of the substrates (with grinding producing more metal fibers than lathing). If not removed, these metal fibers may cause problems since they can affect the performance of devices incorporating the substrates. For photoreceptors, metal fibers attached to the substrate surface may not allow the formation of sufficient charge in the areas located above the metal fibers. Xerographic prints made using such a photoreceptor substrate (containing the attached metal fibers) may have a deletion or a dark spot in the areas associated with the metal fibers. Applicants tolerated the presence of the metal fibers and adjusted the lathing parameters to keep the number of metal fibers produced low. However, it is desirable to remove the metal fibers for a number of reasons. Thus, there is a need which the present invention addresses for a process that can quickly remove metal fibers from substrates.

Conventional electrochemical surface treatments are illustrated in Herbert et al., U.S. Pat. No. 6,048,657; and Vidal et al., U.S. Pat. No. 5,997,722.

SUMMARY OF THE INVENTION

The present invention is accomplished in embodiments by providing a process comprising:

creating a galvanic cell comprised of a substrate as an anode, a cathode, and an electrolytic solution, wherein the substrate includes a metal surface having a plurality of metal fibers connected to the metal surface, wherein the cathode is selected to be more noble than the metal surface resulting in the anode being the working electrode, wherein the galvanic cell spontaneously electrochemically treats the metal surface in the absence of power externally supplied to the galvanic cell; and allowing the spontaneous electrochemical treatment of the metal surface to continue for a time sufficient to sever a number of the metal fibers from the metal surface to result in severed metal fiber fragments unconnected with the metal surface.

DETAILED DESCRIPTION

The present invention involves creating a galvanic cell composed of a substrate as an anode, a cathode, and an electrolytic solution, wherein the substrate includes a metal surface having a plurality of metal fibers connected to the metal surface, wherein the cathode is selected to be more noble (i.e., less active) than the metal surface resulting in the anode being the working electrode. Thus, the metal surface of the anode is less noble (i.e., more active) than the cathode. The anode and cathode are "externally" connected (e.g., a wire connecting the anode and cathode where the wire is not in contact with the electrolytic solution). The cathode may be for example concentric, surrounding the anode. The cathode may be: a noble metal such as gold, silver, platinum, palladium; an inert material such as graphite; or a strongly passive material such as titanium, lead, tantalum, or alloys thereof. The cathode, however, is not limited to a noble metal, an inert material, or a strongly passive material, and in fact can be any material that is more noble than the metal surface of the substrate. The materials for the cathode and the anode can be selected based upon their relative positions in the activity series (also known as electromotive series). In embodiments, the anode and cathode exhibit a voltage difference for example of at least about 0.5 V, in particular at least about 1 V, and especially from about 1 V to about 7 V.

The metal surface is part of a substrate. The substrate can be formulated entirely of an electrically conductive material, or it can be an insulating material having an electrically conductive surface. The entire substrate can comprise the same material as that in the electrically conductive surface or the electrically conductive surface can merely be a coating on the substrate. Any suitable electrically conductive material can be employed. Typical electrically conductive materials include copper, brass, nickel, zinc, chromium, stainless steel, aluminum, semitransparent aluminum, steel, cadmium, titanium, silver, gold, indium, tin, metal oxides including tin oxide and indium tin oxide, and the like. In embodiments, the metal fibers and metal surface are a metal selected from stainless steel, aluminum, and an aluminum alloy. The substrate can be flexible or rigid, and can have any number of configurations such as a cylindrical drum, an endless flexible belt, and the like. The substrate may be used for a number of industrial purposes including for example in photoreceptors, donor rolls, fuser rolls, contact charge rolls, or in any roll (or part, for that matter) that has to interface with a photoreceptor or other device that is charged or partly charged. This is especially the case if the device is coated with a thin layer of a material that has to have uniform electrical properties. One can see how the presence of metal fibers on the substrate would cause the same or similar problem in all of above situations.

The metal fibers typically have the same composition as the metal surface. Following is a description of the metal fibers prior to the present process. The metal fibers may have a length ranging for example from about 20 to about 500 micrometers and a thickness ranging from about 2 to about 15 micrometers. The number of metal fibers may vary depending upon the metal surface and the process causing the formation of the metal fibers. For example, the metal fibers may be present in a concentration ranging from about 0.03 to about 10 metal fibers per square centimeter of metal surface produced via a grinding process, and from 0 to about 1 metal fiber per square centimeter produced via a lathing process. The metal fibers may be straight, slightly curved, or severely bent with the tip pointing in the direction of the metal surface.

The electrolytic solution includes water and an electrolyte. The electrolyte can be any of many salts or weak acids (or well-buffered strong acids). The function of the electrolyte is to make the solution (electrolyte) sufficiently conductive to allow the passage of small currents on the order of for example a few mill-amps. NaCl in concentrations of from about 1 g/L to about 10 g/L can be used, as well as the same concentrations of KCl. Sulfamic acid at concentrations of from about 0.01 to about 0.1 g/L that was buffered with about 35 g/L Boric Acid can be also used. Boric Acid and Phosphoric Acid can be used without any buffer at concentrations of from about 0.1 to about 1.0 g/L. In embodiments, the electrolytic solution can include a wetting agent such as sodium laurel sulfite; the wetting agent may be present in sufficient concentration to lower the surface tension to for instance less than about 50 dynes/cm. As seen in a number of the experimental examples described herein, the electrolytic solution can in embodiments include some acid to increase the electrolytic potential difference.

In embodiments, the present process may sever the metal fibers from the metal surface without substantially affecting the surface characteristics of the metal surface such as surface roughness, reflectivity, and/or pitting. In other embodiments, the present process may substantially affect the surface characteristics of the metal surface such as surface roughness, reflectivity, and/or pitting. On a trial and error basis, one can adjust the process parameters in order to balance the desired surface characteristics (e.g., surface roughness, reflectivity, and/or pitting) with the objective of severing of the metal fibers from the metal surface.

Surface roughness is measured in micrometers and is expressed as either the arithmetical mean deviation (Ra or AA) or the root-mean-square deviation (Rq or RMS). A full explanation of these measurements can be found in DIN 4762, DIN 4768, and ISO 4287/1. In embodiments, the surface roughness of the substrate before treatment may be from about 0.140 to about 0.450 micrometers Ra and the surface roughness of the substrate after treatment may be the same. In embodiments, a surface roughness of less than about 0.140 Ra may cause the plywood print defect. These measurements can be done on a Perthometer S8P using a 2 micrometer stylus operating perpendicular to the grinding or lathing pattern (lines). DIN 4762 and/or ISO 4287/1 describe additional operating parameters (e.g., cut off, sample length, and stylus speed).

While one could measure reflectivity (such as by measuring Automatic Density Control), it is also possible to use Ra as a surrogate for reflectivity.

After creating the galvanic cell, the galvanic cell spontaneously electrochemically treats the metal surface in the absence of power externally supplied to the galvanic cell. An oxidation reaction occurs at the anode. The spontaneous electrochemical treatment is allowed to continue for a time sufficient to sever a number of the metal fibers, at a point ranging for example from the metal surface to about halfway up the length of the metal fibers, from the metal surface. The spontaneous electrochemical treatment of the metal surface continues for a time period ranging for example from about 0.25 minute to about 5 minutes, in particular from about 0.5 minute to about 3 minutes, and especially no more than about one minute. After achieving the desired result, the electrochemical treatment can be stopped by, for example, removing one or both electrodes from the electrolytic solution or by disconnecting the external connection between the anode and cathode.

The term "sever" indicates loss of physical connection of the severed metal fiber fragment to the metal surface where the instant process achieves severing without entirely consuming or disintegrating each metal fiber. The resulting severed metal fiber fragment has a length ranging for example from about 20 to about 500 micrometers. The severed metal fiber fragments can be found in the electrolytic solution or at the bottom of the vessel. Each of the severed metal fiber fragments leaves behind on the metal surface a remaining metal fiber length ranging for instance from 0 to about 5 micrometers, particularly from 0 to about 2 micrometers, that is connected to the metal surface. In embodiments, the remaining metal fiber length and/or severed metal fiber fragments may undergo some dissolution during the present process. It is not fully understood how the present process severs the metal fibers. Perhaps the present process involves burning, dissolution, or a combination thereof.

At atmospheric pressure, the electrolytic solution temperature is approximately 25° C. However, the present process may be conducted at any suitable temperature including for example from about 18 to about 35° C., particularly from about 20 to about 23° C.

Advantages of the present invention include one or more of the following: A surface significantly free of the metal fibers (that may cause black spots or deletions in the case of a photoreceptor); a surface that will not cause the plywood print defect in the case of a photoreceptor; a process that is fast; a process that is relatively inexpensive; and a process that does not use chemicals that are harmful to the operators or the environment.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLES

Sample preparation and testing were similarly performed in the examples. The operating parameters are described in the examples. Freshly ground 304 stainless steel or 6063 alloy aluminum photoreceptor substrates (340 mm long with 30 mm outside diameter) were inspected for metal fibers using 50× magnification. If more than 20 fibers were found on the substrates and were substantially uniform in their distribution, especially on one end versus the other, the substrates were washed using a gentle flow of acetone. After washing, the substrates were marked with indelible ink on their inside surface at their upper end. Next, the surface roughness (Ra) was measured using a 2 micron stylus run perpendicular to the grinding marks on a Perthometer S8P. Ra was measured 8 times around each sample's circumference 20 mm from each end of the substrate. After recording the identifying mark and the average Ra obtained at each end, each sample was stored in a clean covered box until it was subsequently treated.

One half of each sample was then subjected to the electrolytic treatment by submerging the sample half way into the electrolytic solution. The samples were held at their tops with a titanium spring that fit snugly into their inside diameter during the electrolytic treatment. The samples were made to be anodic compared to the counter (2nd) platinum electrode by connecting the un-submerged portion of the two electrodes via a copper wire. After the electrolytic treatment, the samples were gently rinsed with 9 million ohm deionized water and then allowed to air dry. Subsequent to this, Ra was again measured (8 times at both ends as before) and recorded. The samples were processed through a photoreceptor coating process where they were coated over their entire length with an undercoat layer, a charge generating layer, and a charge transport layer.

After coating, the samples were print tested in a Xerox printer/copier machine that produces black spots when there is a problem maintaining an appropriate charge in the photoconductor system. The change in Ra (if any) and the print test results (top versus bottom of each sample) were evaluated and recorded. In the examples the substrate top half (which received no electrolytic treatment) exhibited the following characteristics: no plywood defect phenomenon; at least 10 black spots; and no pits. In the examples, the absence of black spots indicated that the present process succeeded in severing the metal fibers from the metal surface.

Example 1

| | |
|---|---|
| Substrate | Aluminum |
| Counter Electrode | Platinum |
| Electrolyte | 1 g/L NaCl in $H_2O$ |
| Temperature | 21° C. |
| Delta Voltage | 0.865 |
| Time | 2 min. |
| Results | |
| Black Spots | None |
| Plywood | None |
| Pitting | None |
| Ra | No Change. |

Example 2

| | |
|---|---|
| Substrate | Aluminum |
| Counter Electrode | Platinum |
| Electrolyte | 1 g/L NaCl in $H_2O$ with 1% vol/vol concen. $H_3PO_4$ |
| Temperature | 21° C. |
| Delta Voltage | 1.234 |
| Time | 0.5 min. |
| Results | |
| Black Spots | None |
| Plywood | None |
| Pitting | None |
| Ra | No Change. |

Example 3

| | |
|---|---|
| Substrate | Stainless Steel |
| Counter Electrode | Platinum |
| Electrolyte | 1 g/L NaCl in $H_2O$ |
| Temperature | 21° C. |
| Delta Voltage | 0.360 |
| Time | 5 min. |
| Results | |
| Black Spots | None |
| Plywood | None |
| Pitting | None |
| Ra | No Change. |

Example 4

| | |
|---|---|
| Substrate | Stainless Steel |
| Counter Electrode | Platinum |
| Electrolyte | 1 g/L NaCl in $H_2O$ with 1% vol/vol concen. $H_3PO_4$ |
| Temperature | 21° C. |
| Delta Voltage | 0.556 |
| Time | 1 min. |
| Results | |
| Black Spots | None |
| Plywood | None |
| Pitting | None |
| Ra | No Change. |

Other modifications of the present invention may occur to those skilled in the art based upon a reading of the present disclosure and these modifications are intended to be included within the scope of the present invention.

We claim:

1. A process comprising:

creating a galvanic cell comprised of a substrate as an anode, a cathode, and an electrolytic solution, wherein the substrate includes a metal surface having a plurality of metal fibers connected to the metal surface, wherein the cathode is selected to be more noble than the metal surface resulting in the anode being the working electrode, wherein the galvanic cell spontaneously electrochemically treats the metal surface in the absence of power externally supplied to the galvanic cell; and allowing the spontaneous electrochemical treatment of the metal surface to continue for a time sufficient to sever a number of the metal fibers from the metal surface to result in severed metal fiber fragments unconnected with the metal surface.

2. The process of claim 1, wherein the metal fibers are severed from the metal surface at a point ranging from the metal surface to about halfway up the length of the metal fibers.

3. The process of claim 1, wherein the anode and the cathode exhibit a voltage difference of at least about 0.5 V.

4. The process of claim 3, wherein the anode and the cathode exhibit a voltage difference of at least about 1 V.

5. The process of claim 3, wherein the anode and the cathode exhibit a voltage difference ranging from about 1 V to about 7 V.

6. The process of claim 1, wherein each of the severed metal fiber fragments leaves behind on the metal surface a remaining metal fiber length ranging from 0 to about 5 micrometers that remains connected to the metal surface.

7. The process of claim 1, wherein each of the severed metal fiber fragments has a length ranging from 20 to about 500 micrometers.

8. The process of claim 1, wherein the metal fibers and metal surface are a metal selected from stainless steel, aluminum, and an aluminum alloy.

9. The process of claim 1, wherein the spontaneous electrochemical treatment of the metal surface continues for a time period ranging from about 0.25 minute to about 5 minutes.

10. The process of claim 1, wherein the spontaneous electrochemical treatment of the metal surface continues for a time period ranging from about 0.5 minute to about 3 minutes.

11. The process of claim 1, wherein the spontaneous electrochemical treatment of the metal surface continues for no more than about one minute.

12. The process of claim 1, further comprising carrying out the spontaneous electrochemical treatment of the metal surface at a temperature ranging from about 18 to about 35 degrees C.

* * * * *